United States Patent [19]

Campbell et al.

[11] 4,168,976

[45] Sep. 25, 1979

[54] PHOTOGRAPHIC FILM UNITS CONTAINING AZA HETEROCYCLIC POLYMERIC MORDANTS

[75] Inventors: Gerald A. Campbell, Webster; Lewis R. Hamilton, Rochester, both of N.Y.

[73] Assignee: Eastman Kodak Company, Rochester, N.Y.

[21] Appl. No.: 894,862

[22] Filed: Apr. 10, 1978

[51] Int. Cl.[2] ..... G03C 5/54; G03C 1/48; G03C 1/40; G03C 1/10

[52] U.S. Cl. ..... 96/29 D; 96/73; 96/74; 96/76 R; 96/77; 96/84 A; 96/95; 96/96; 96/99; 96/100 R; 96/101; 96/107; 96/109; 96/111; 96/114; 96/120; 101/464

[58] Field of Search ..... 96/3, 29 D, 77, 84 A, 96/114, 1 N, 76 R, 67, 119 R, 95, 99, 100, 109, 107, 120, 101, 73, 112, 96, 74; 428/500, 522; 101/464

[56] References Cited

U.S. PATENT DOCUMENTS

| | | | |
|---|---|---|---|
| 3,362,827 | 1/1968 | Oishi et al. | 96/111 |
| 3,445,438 | 5/1969 | Honig et al. | 260/88.3 |
| 4,124,386 | 11/1978 | Yoshida et al. | 96/77 |

FOREIGN PATENT DOCUMENTS 1306544 2/1973 United Kingdom .

*Primary Examiner*—Richard L. Schilling
*Attorney, Agent, or Firm*—Arthur H. Rosenstein

[57] ABSTRACT

A photographic element comprising a support, a layer containing certain photographically useful fragments and a layer containing a dye mordant composition comprising a polymer having recurring units of the formula:

wherein:

A comprises polymerized units of ethylenically unsaturated monomers;

R is H or alkyl;

$R^1$ is H, alkyl or is a group containing at least one atomatic nucleus;

Q is a linking group;

Y is H or an inert group;

X is a leaving group;

E and F are the atoms necesary to complete a 5–7 membered heterocyclic ring;

n is 0 to 2;

m is 1 to 3;

p is 0 or 1;

x is 0 to 90 weight percent; and y is 10 to 100 weight percent of the polymer.

The polymeric mordants covalently bond with dyes or dye precursors and are especially useful in diffusion transfer processes.

26 Claims, No Drawings

PHOTOGRAPHIC FILM UNITS CONTAINING AZA HETEROCYCLIC POLYMERIC MORDANTS

The present invention relates to novel photographic elements containing polymeric compounds as dye mordants.

It is known in the photographic art to use various polymeric materials and mordants in color image-transfer elements comprising a support and layer generally containing a silver halide emulsion. The mordant receives dyes migrating thereto and prevents the migration of dyes or other photographically useful and/or active fragments therefrom. Receiving elements containing mordants are described, for example, in U.S. Pat. Nos. 2,584,080 and 3,770,439.

Many of the polymeric mordants described in the prior art are quite useful in preventing migration of the dyes from the mordanted layer. Polymeric mordants useful in this respect include those described in U.S. Pat. Nos. 3,958,995 and 3,526,694. While many nonionic, anionic and cationic polymers have been found to be satisfactory mordants for use in image-transfer units, it would be desirable to provide mordants which can better receive and hold dyes from migration.

In copending U.S. application Ser. No. 839,879, filed Oct. 6, 1977, by Campbell, Hamilton, Cohen and Villard, now abandoned and entitled "Photographic Film Units Containing a Polymeric Mordant Which Covalently Bonds with Certain Dyes," certain polymers which covalently bond with dyes containing suitable reactive groups are disclosed as mordants in photographic processes.

In U.S. Pat. Nos. 3,362,827 and 3,445,438 and British Pat. No. 1,306,544, similar polymers to those described herein are disclosed. There is no disclosure of any photographic use of the polymers described herein, however, in association with photographically useful or active fragments containing reactive groups which covalently bond with the polymers.

Photographic elements containing polymeric mordants which have particularly strong holding properties with respect to certain dyes particularly in integral image-transfer units have been sought in the art. Photographic elements having these properties are obtained by incorporating in the element particular photographically useful fragments, such as dye or dye precursors, and polymeric mordants which contain reactive groups which will covalently bond to the photographically useful fragments.

The photographically useful fragment (PUF) useful herein can be any nucleophilic fragment which is released in a photographic element, preferably in an imagewise fashion. For example, the photographically useful group can be a photographic dye or dye precursor, or a photographic reagent such as a development inhibitor, a development accelerator, a bleach inhibitor, a bleach accelerator, a coupler (e.g., a competing coupler, a color-forming coupler, a development inhibitor releasing coupler), a developing agent (e.g., a competing developing agent), a silver halide solvent, a silver complexing agent, a fixing agent, a toner, a hardener, a fogging agent, an antifoggant, a chemical or spectral sensitizer, or a desensitizer, said PUFs containing therein aminoalkyl, sulfonamido and phenolic groups as described hereafter.

The photographically useful group can be present in the photographic element as a preformed species or it can be present as a precursor, such as in a blocked form. Generally, the precursor is the penultimate precursor.

The dye or dye precursor described above can include a moiety which is an image-dye former. The term "image-dye former" is understood to refer to those compounds which undergo reactions encountered in a photographic imaging system to produce an image dye, such as color couplers, oxichromic compounds and the like.

The PUF materials described herein have particular application in a diffusion transfer process where it is desired to have a dye entity transferred to a receiving element. However, in certain embodiments, this invention relates to the release of an imagewise distribution of a diffusible photographically useful compound which is a photographic reagent. Typical useful photographic reagents are known in the art, such as in U.S. Pat. Nos. 3,227,551; 3,698,898; 3,379,529; 3,728,113; and 3,364,022.

As described above, the photographically useful fragment can be a silver halide development inhibitor, such compounds include triazoles and tetrazoles, such as a 5-mercapto-1-phenyltetrazole, a 5-methylbenzotriazole, a 5,6-dichlorobenzotriazole and the like. As described above, the PUF can be an antifoggant, such as an azaindene compound, e.g., a tetrazaindene, and the like. The compounds which contain releasable silver halide development inhibitors or antifoggants can generally be used in a photographic element in association with silver halide layers. Such compounds can be incorporated in amounts such as 0.01 to 1 $g/m^2$ dissolved in a coupler solvent such as diethyl lauramide. When these compounds are incorporated in photographic elements in association with negative silver halide emulsions, a positive imagewise distribution of inhibitor or antifoggant will be produced upon development if released from a positive working dye releaser. Thus, silver development is inhibited or restrained in the low-exposure toe but not in the shoulder portion of the sensitometric density v. long exposure curve. Development inhibition of the unexposed areas is thereby achieved selectively. If the silver halide emulsions also have dye releasers associated therewith, the overall effect of the inhibitor or antifoggant released is to cause more dye to be released in the unexposed regions. This will improve maximum image dye density in the image-receiving layer without increasing the amount of dye released in the exposed regions.

As described above, the photographically useful fragment can also be a silver halide development accelerator, such as nucleophilic-substituted benzyl alcohol or benzylpicolinium bromide; foggants including hydrazines and hydrazides such as an N-acetyl-N'-phenylhydrazine, and the like; or auxiliary developers such as hydroquinones, a 1-phenyl-3-pyrazolidone, an ascorbic acid and the like.

When color couplers are used as the PUFs of photographic elements of this invention, after exposure and development, the coupler can be released in areas where no development occurs and can diffuse to a receiving layer where they can be reacted with an oxidized color developer such as a primary aromatic amine to form an image dye. Generally, the color coupler and the color developer are so chosen that the reaction product is immobile. Typical color couplers useful as PUFs include the pyrazolone couplers, pyrazolotriazole couplers, open-chain ketomethylene couplers, phenolic couplers and the like. Further reference to the description of appropriate couplers is found in Marchant, U.S. Pat. No. 3,620,747 issued Nov. 16, 1971, which is incorporated herein by reference.

Fragments containing oxichromic moieties, as described above, when used in a photographic system are generally colorless materials due to the absence of an image-dye chromophore. Thus, they can be used directly in a photographic emulsion or in a layer over the emulsion layer with respect to the exposure direction without competitive absorption. Compounds of this type undergo chromogenic oxidation to form the respective image dyes. The oxidation can be carried out by aerial oxidation, incorporation of oxidants into the photographic element of film unit, or use of an oxidant during processing. Compounds of this type have been referred to in the art as leuco compounds, i.e., compounds which have no color. Typical useful oxichromic compounds as PUF in this invention include leuco indoanilines, leuco indophenols, leuco anthraquinones and the like. In certain preferred embodiments, the compounds of this invention contain oxichromic moieties as described in Lestina and Bush, U.S. Pat. No. 3,880,658, which is incorporated herein by reference.

The PUF materials described above including dyes, dye precursors or dyes released from dye-providing compounds useful in this invention are those having appended thereto a nucleophilic moiety selected from the group consisting of aminoalkyl preferably having the formula $ZNHR^2$, sulfonamido preferably having the formula

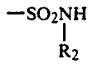

and phenolic preferably having the formula

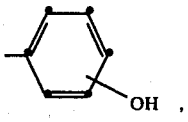

wherein $R^2$ is H or alkyl, preferably containing from about 1 to about 6 carbon atoms such as ethyl, methyl, isopropyl, chlorobutyl and the like; Z is an alkylene or cycloalkylene group preferably containing from 1 to 6 carbon atoms, such as methylene, ethylene, cyclohexylene, and the like, or arylenealkylene, such as phenylenemethylene, or the atoms which, taken together with $NHR^2$, completes an N-containing heterocyclic group, preferably containing from 5 to 7 carbon atoms. Dyes, dye precursors and dyes released from dye-providing materials containing these groups are preferred and are well known to those skilled in the art.

Examples of dyes or dye precursors containing the $ZNHR^2$ groups described above include amine dyes such as

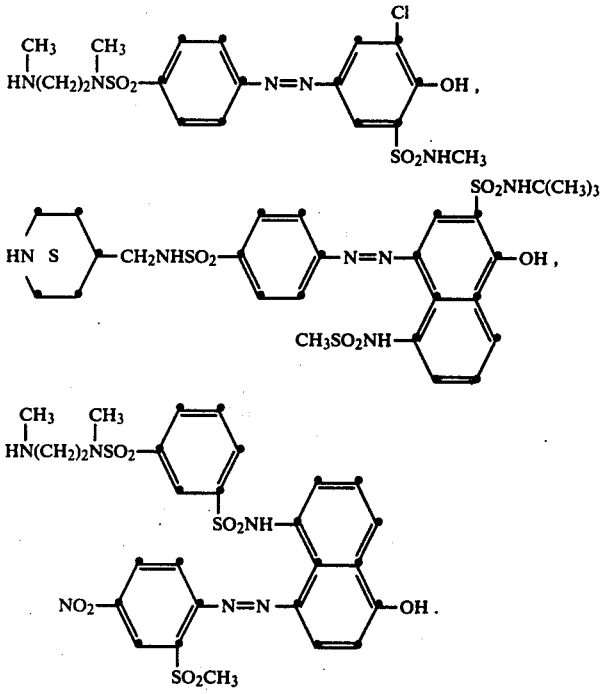

Examples of those dyes or dye precursors containing $—SO_2NHR^2$ groups described above are sulfonamido dyes such as:

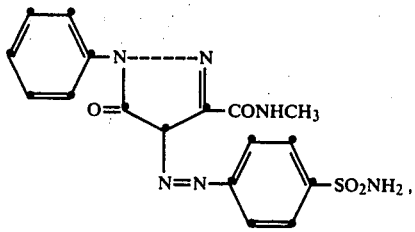

-continued

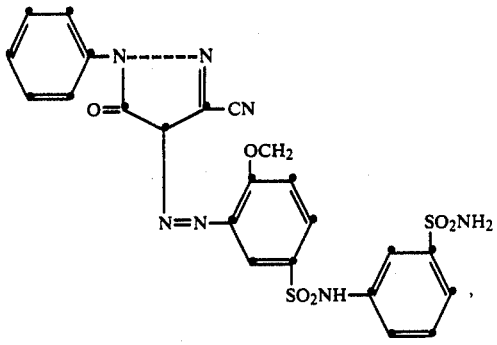

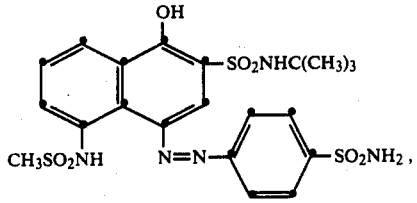

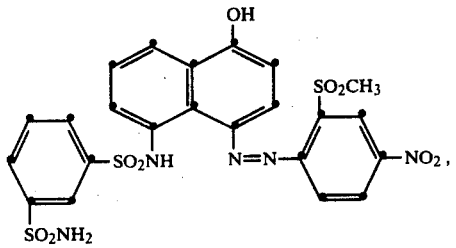

and the like.

Examples of those dyes or dye precursors described above containing:

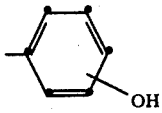

groups are phenol dyes such as:

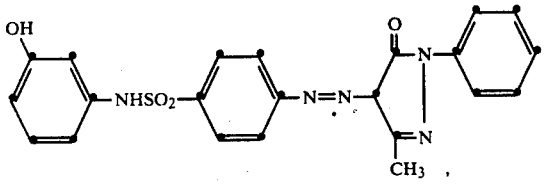

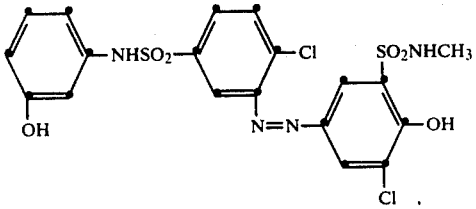

-continued

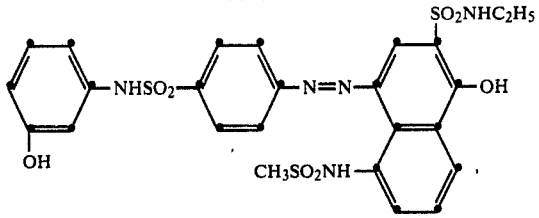

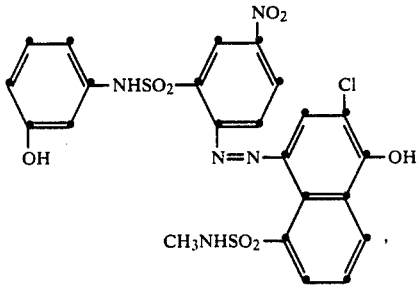

and the like.

In general, image dye precursors are those materials which contain the chromophore of the desired image dye in a latent state, including, for example colorless compounds such as leuco dyes that are converted to image dyes by oxidation, and shifted dyes which are initially decolorized but whose maximum absorption can be shifted to the desired image hue by chemical means such as hydrolysis, pH change, etc.

Any of the dyes or dye precursors described above can be released from dye-providing compounds such as those described in Fleckenstein et al U.S. published patent application Ser. No. B 351,673, Jan. 28, 1975 now U.S. Pat. No. 4,076,529, which is incorporated herein by reference.

The polymeric mordants useful in this invention to bond covalently with the classes of PUFs described above are nonionic, anionic or cationic homopolymers or copolymers containing recurring units having the formula:

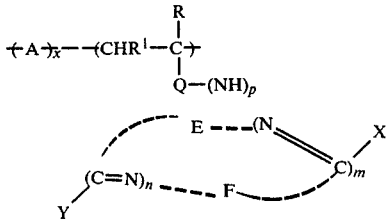

wherein A represents polymerized units of $\alpha,\beta$-ethylenically unsaturated monomers such as acrylamide, methyl methacrylate, butyl acrylate, styrene, N-isopropylacrylamide, sodium 2-acrylamido-2-methylpropanesulfonate, 2-sodiosulfoethyl methacrylate, N-(2-methacryloyloxyethyl-N,N,N-trimethylammonium chloride, N-vinylbenzyl-N,N,N-trimethylammonium chloride and the like;

R is H or alkyl preferably containing from 1 to 6 carbon atoms such as methyl, ethyl, isobutyl, hexyl and the like;

Q is a bivalent linking group providing a linkage between the polymerized vinyl group and the heterocyclic group and can be selected from the group consisting of alkylene, preferably containing from about 1 to about 6 carbon atoms, such as methylene, isopropylene, hexamethylene and the like; arylene, preferably containing from about 6 to about 10 carbon atoms, such as phenylene, naphthylene and the like; arylenealkylene, preferably containing from about 7 to about 11 carbon atoms, such as those having the formula

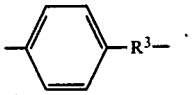

including phenylenemethylene; $COOR^3$; and $CONHR^3$ wherein $R^3$ is selected from the group consisting of arylene, alkylene or arylene-alkylene, such as described above;

$R^1$ is H; lower alkyl, preferably containing from 1 to 6 carbon atoms, such as methyl, ethyl, propyl, n-butyl, t-butyl and the like; a group containing at least one aromatic nucleus including, for example, aryl and substituted aryl such as phenyl, tolyl, naphthyl and the like or the atom which taken together with Q forms a

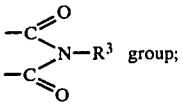

X is a leaving group, which can undergo nucleophilic displacement, such as chloro, bromo, iodo, alkyl and aryl sulfonyl, alkyl and arylsulfonyloxy ($—OSO_2R'$), an onium group such as trialkylammonium, dialkylsulfonium and the like, ammonio, sulfato ($—OSO_3^-$) and the like;

Each Y is H or an inert group (a group which does not undergo nucleophilic displacement under normal conditions) such as alkyl or aryl amine such as methylamine, phenylamine and the like; alkoxy such as ethoxy, phenoxy, hydroxy; alkyl such as methyl, propyl, hexyl and the like; and aryl such as phenyl, naphthyl and the like;

E and F represent separately the atoms necessary to complete a 5 to 7 membered heterocyclic ring, such as triazine, pyrimidine, pyrrole, imidazole and the like;

n is 0, 1 or 2;

m is 1, 2 or 3;

p is 0 or 1;

and x and y are the weight fractions of the respective monomeric units in the copolymer wherein x is from 0 to 90 weight percent, and preferably from 30 to 70 weight percent, and y is from 10 to 100 weight percent, and preferably from 70 to 30 weight percent of the copolymer.

It is understood that, wherever alkyl, aryl or alkylene is referred to herein, the terms are meant to include isomers and substituted groups as long as the substituent does not adversely affect the covalent bonding of the dye to the polymer.

The polymers containing the recurring units described above comprise anionic, cationic or nonionic polymers comprised of the above units . Although the preferred copolymerizable monomers (A) in the above formula form units which act as mordants for dyes in themselves, basically any polymerizable monomer (A) may be used to form the polymeric mordant.

Cationic polymers can be formed by copolymerizing monomers forming the units described in the above formula where monomer (A) forms repeating units such as:

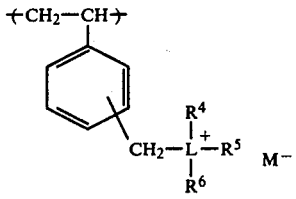

wherein L is N or P, $R^4$ to $R^6$ are independently carbocyclic or alkyl groups, and $M^-$ is an anion such as described in U.S. Pat. No. 3,958,995, as well as other cationic units such as N-[(methacryloyloxyethyl)-N,N,N-trimethylammonium methosulfate], N-(methacryloaminopropyl)-N,N,N-trimethylammonium chloride and the like.

Anionic polymers can be formed by copolymerizing monomers forming the units described in the above formula wherein monomer (A) forms repeating units such as 2-sodiosulfoethyl methacrylate, sodium 2-acrylamido-2-methylpropanesulfonate, sodium vinylbenzylsulfonate, sodium vinylbenzenesulfonate and the like.

Nonionic polymers can be formed by copolymerizing monomers wherein monomer (A) of the above formula forms repeating units such as acrylamide, N-vinylpyrrolidinone, N-isopropylacrylamide and the like.

Preferred cationic polymers, according to the invention, are poly[vinylbenzyltrimethylammonium chloride-co-2-(4-vinylphenylamino)-4,6-dichloro-s-triazine]; poly[vinylbenzyltrimethylammonium chloride-co-4-(4-vinylphenylamino)-2,5,6-trichloropyrimidine]; poly[-vinylbenzyltrimethylammonium chloride-co-2-methoxy-4-(4-vinylphenylamino)-6-chloro-s-triazine]; poly[2-methacryloyloxyethyltrimethylammonium methosulfate-co-2-(methacryloyloxyethylamino)-4,6-dichloro-s-triazine]; poly[N,N,N-trimethyl-N-vinylbenzylammonium chloride-co-2-(3-methacrylamidopropylamino)-4,6-dichloro-s-triazine] and the like.

Preferred nonionic copolymers, according to the invention, include poly[acrylamide-co-2-(3-methacrylamidopropylamino)-4,6-dichloro-s-triazine] and the like.

Preferred anionic copolymers, according to the invention, include poly[2-sodiosulfoethyl methacrylate-co-2-methacryloyloxyethylamino)-4,6-dichloro-s-triazine] and the like.

The homopolymers or copolymers can be formed by free radical polymerization of the corresponding monomers.

The monomer

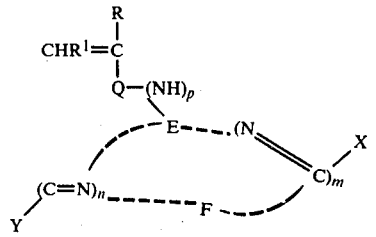

used to form a homopolymer or copolymer of the invention can be prepared by condensing an addition polymerizable monomer which contains a reactive primary or secondary amine or alcohol group with a chloro-containing aza heterocycle such as cyanuric chloride and the like. Alternatively, hydroxyalkylchloro aza heterocycles can be condensed with acid chloride monomers such as acrylyl or methacrylyl chloride.

The polymers and PUFs of this invention form a covalent bond on contact. A simple test to determine the formation of the covalent bonding comprises:

(a) preparing a dye-receiving element by coating a poly(ethylene terephthalate) film support with a layer comprising gelatin at 2.16 g/m$^2$, a bis(vinylsulfonylmethyl) ether hardener at 0.04 g/m$^2$, and the polymeric mordant to be tested at 5.5 millimoles/m$^2$ of reactive unit of the mordant;

(b) immersing separate samples of receiving element in 1.0 percent by weight aqueous solution of the dye for up to 10 minutes, washing in water for 20 minutes and air-drying; and (c) measuring the dye density at maximum absorption and determining the percentage of covalent bonding from the dye density lost after subsequent treatment of each sample for 2 minutes in a solvent mixture consisting of 200 ml. of methanol, 200 ml. of $CH_2Cl_2$, 20 ml. of water and 10 g $NH_4SCN$, which solvent removes substantially all dye not covalently bonded. The percentage of dye or dye precursor covalently bonded to the polymer should be at least 5% and preferably 50 to 100%.

The dye mordant composition of the invention is quite useful in the preparation of photographic elements comprising a support and at least one layer comprising the dye mordant and at least one layer comprising a dye or dye precursor. The support can comprise any photographic support material such as paper, baryta-coated paper, resin-coated paper, pigment-coated polymeric film, poly(ethylene terephthalate), cellulose acetate, glass, grained aluminum, polycarbonates and the like such as described in *Product Licensing Index,* Vol. 92, December, 1971, publication 9232, pp. 107–110. The support can consist of any of the above materials or like materials coated with various layers such as timing layers, overcoat layers, acid layers and the like. The support is coated with a substantially aqueous dispersion of the polymer according to the invention, and thereafter the layer or layers containing the dyes or dye precursors are applied.

In a highly preferred embodiment, this invention relates to image-transfer film units comprising:

(a) a photosensitive element comprising a support having thereon at least one layer containing a silver halide emulsion having associated therewith an image dye-providing material containing or which releases a nucleophilic moiety containing the ZNHR, $SO_2NHR^2$ or

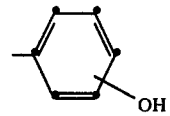

moieties described above;

(b) an image-receiving layer containing the above-described mordants; and (c) an alkaline processing composition and means containing same adapted to discharge its contents within said film unit.

Mordanting amounts of the polymers according to this invention can be employed as such from a substantially aqueous medium or can be incorporated in water-permeable hydrophilic organic colloid binders and the resulting mixture used in the preparation of dye imbibition printing blanks, receiving layers for color-transfer processes such as those described by U.S. Pat. No. 3,362,819 by Land, No. 2,983,606 by Rogers, No. 3,227,552 by Whitmore and No. 3,227,550, and in antihalation layers such as those described by Jones, et al, U.S. Pat. No. 3,282,699. Satisfactory colloids which can be used for this purpose include any of the hydrophilic colloids generally employed in the photographic field including, for example gelatin, colloidal albumin, polysaccharides, cellulose derivatives, synthetic resins such as polyvinyl compounds, including polyvinyl alcohol derivatives, acrylamide polymers and the like. In general, a mordanting amount can be employed in a dye-mordanting or dye image-receiving layer. The amount of dye mordant to be used depends on the amount of dye to be mordanted, the mordanting polymers, the imaging chemistry involved, etc. The amount can be determined easily by one skilled in the art. The dye image-receiving element can comprise a support having the polymeric mordant of this invention thereon. The element may also comprise other layers such as a polymeric acid layer and can also include a timing layer as taught in U.S. Pat. No. 2,584,030 and disclosed in U.S. Pat. No. 3,362,819 or a light-reflective interlayer comprising a light-reflective white pigment such as $TiO_2$ and the polymeric binder in accordance with the teaching of Beavers and Bush, U.S. Pat. No. 3,445,228.

The mordanting polymers according to this invention are also especially useful in light-filtering layers such as in antihalation layers of the type disclosed by Jones and Milton, U.S. Pat. No. 3,282,699. Here, the light-filtering layer preferably can comprise a hydrophilic colloid and the polymer of this invention. The layer is adapted to contain a dye held or fixed by the mordant.

In certain preferred embodiments, the mordants of this invention are employed in image-transfer film units to mordant the image dye. The mordants can generally be used in any image-transfer film unit format where initially mobile compounds are used, such as dye developers, or where initially immobile compounds are used, such as compounds which release a diffusible dye as a function of oxidation of the compound. Typical useful image-transfer formats are disclosed in U.S. Pat. Nos. 2,432,181, 2,983,606, 3,227,550, 3,227,552, 3,415,645, 3,415,644, 3,415,646 and 3,635,707, Canadian Pat. No. 674,082 and Belgian Pat. Nos. 757,959 and 757,960, both issued Apr. 23, 1971. In highly preferred embodiments, the mordants of this invention are used in the photographic element of an image-transfer film unit which is designed to be processed with a single processing solution, and the resulting positive image is viewed through a transparent support and against an opaque background.

In highly preferred embodiments, the mordants of this invention are useful in color image-transfer film units which comprise:

(a) a photosensitive element comprising a support having thereon at least one layer containing a silver halide emulsion having associated therewith an image dye-providing material and preferably three of said layers which contain, respectively, a blue-sensitive silver halide emulsion, a green-sensitive silver halide emulsion and a red-sensitive silver halide emulsion;

(b) an image-receiving layer containing the mordants of the above formula which can be located on a separate support and superposed on said support containing said silver halide emulsion layers or, preferably, it can be coated on the same support adjacent the photosensitive silver halide emulsion layers; and (c) means containing an alkaline processing composition adapted to discharge its contents within said film unit.

Where the receiver layer is coated on the same support with the photosensitive silver halide layers, the support is preferably a transparent support, a reflecting layer and opaque layer are preferably positioned between the image-receiving layer and the photosensitive silver halide layer, and the alkaline processing composition preferably contains an opacifying substance such as carbon or a combination of a pH-indicator dye and a pigment such as $TiO_2$ which is discharged into the film unit between a dimensionally stable support or cover sheet and the photosensitive element.

In certain embodiments, the cover sheet can be superposed or adapted to be superposed on the photosensitive element. The mordant layer can be located on the cover sheet. In certain preferred embodiments where the image-receiving layer is located in the photosensitive element, a neutralizing layer is located on the cover sheet.

A means for containing the alkaline processing solution can be any means known in the art for this purpose, including rupturable containers positioned at the point of desired discharge of its contents into the film unit and adapted to be passed between a pair of juxtaposed rollers to effect discharge of the contents into the film unit, frangible containers positioned over or within the photosensitive element, hypodermic syringes, and the like.

The term "image dye-providing material" as used herein is understood to refer to those compounds which either do not require a chemical reaction to form the image dye or undergo reactions encountered in photographic imaging systems to produce an image dye, such as with color couplers, oxichromic compounds (leuco dyes), pre-formed dyes including indicator dyes, shifted dyes, and the like.

The terms "initially diffusible" and "initially immobile" as used herein refer to compounds which are incorporated in the photographic element and, upon contact with an alkaline processing solution, are substantially diffusible or substantially immobile, respectively.

The image dye-providing materials, in one embodiment where negative silver halide emulsions are used, can be initially mobile image dye-providing materials such as those used in image-transfer photographic elements. Typical useful, initially mobile image dye-providing materials include dye developers as disclosed in U.S. Pat. Nos. 2,983,606, 3,255,001 and the like; oxichromic developers which undergo chromogenic oxidation to form image dyes as disclosed in U.S. Pat. No. 3,880,658; shifted indophenol dye developers as disclosed by Bush and Reardon, U.S. Pat. No. 3,854,985; metallized dye developers as disclosed in U.S. Pat. Nos. 3,482,972, 3,544,545, 3,551,406 and 3,563,739; and the like, all of which are incorporated herein by reference.

The image dye-providing material in another preferred embodiment, especially when negative silver halide emulsions are used, is an initially immobile image dye-providing material. Preferably, the initially immobile image dye-providing material is a positive-working immobile photographic compound such as disclosed by Hinshaw and Condit, British Pat. No. 1,464,104 and U.S. Pat. No. 3,980,479 which are incorporated herein by reference.

Other especially preferred image dye-providing materials for use with negative emulsions to produce positive dye images are the quinonyl carbonates, quinonylmethyl carbonates, and α-nitro-arylcarboxamides described in Chasman, Dunlap and Hinshaw, U.S. application Ser. No. 775,025 filed Mar. 7, 1977 and Hinshaw and Henzel U.S. application Ser. No. 775,219 filed Mar. 7, 1977.

In another embodiment, immobile image dye-providing compounds can be used in association with silver halide emulsions wherein said compounds undergo oxidation followed by hydrolysis to provide an imagewise distribution of a mobile image dye. Compounds of this type can be used with negative emulsions to form positive image records in the exposed photographic element, or they can be used with direct-positive or reversal emulsions to form positive transfer images such as in an image-transfer film unit. Typical useful compounds of this type are disclosed in Canadian Pat. No. 602,607 by Whitmore, et al issued Aug. 2, 1960, U.S. published patent application Ser. No. B 351,673 by Fleckenstein, et al, published Jan. 28, 1975 now U.S. Pat. No. 4,076,529.

In highly preferred embodiments, the mordants of the above formula are used in image-transfer film units which also contain an immobile image dye-providing material which releases a sulfonamido dye as a function of oxidation as disclosed by Fleckenstein et al, U.S. published patent application Ser. No. B 351,673, now U.S. Pat. No. 4,076,529, and Fleckenstein, U.S. Pat. No. 3,993,638.

In still other embodiments, the above mordants can be used in image-transfer film units containing a layer comprising a negative silver halide emulsion and having an adjacent layer containing physical development nuclei associated with an image dye-providing material. Typical photographic elements of this type are disclosed in U.S. Pat. No. 3,227,551 (col. 6–7) and British Pat. No. 904,364 (p. 19).

The dye image-providing material useful in this invention need only have appended thereto a moiety selected from the group consisting of ZNHR, $SO_2NHR^2$ and:

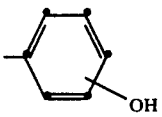

wherein $R^2$ and Z are as described above. The sulfonamido dye releasers described by Fleckenstein, et al in U.S. published patent application Ser. No. B 351,673 can be prepared containing the moieties described above by the methods described therein.

The mordants can also be used for fixing the dyes used in the preparation of photographic filter, antihalation and gelatino-silver-halide emulsion layers. Such layers can be coated on conventional photographic supports, such as flexible sheet supports (e.g. cellulose acetate, polyester films, polyvinyl resins, etc.) or paper, glass, etc.

More than one of the mordanting polymers of this invention can be used together, in a single layer or in two or more layers. The mordanting polymers of this invention can also be used in admixture with other mordants in the same layer or in separate layers of the same element.

It is noted herein that the term "in reactive association with" is intended to mean that the materials can be in either the same or different layers so long as the materials can perform reactive functions with each other.

In a particularly preferred image-transfer process using an image-transfer unit containing the dye or dye precursors and the polymeric mordants of this invention, a color image can be transferred to an image-receiving layer by using a film unit comprising a transparent support coated with the image-receiving layer containing the polymeric mordants, an opaque light-reflective layer, a black opaque layer and photosensitive layers having associated therewith dye image-providing materials containing the groups capable of forming covalent bonds with the polymer mordants. A rupturable container containing an alkaline processing composition and an opacifier such as carbon black is positioned adjacent the top layer and a transparent cover sheet. The cover sheet can comprise a transparent support which is coated with a neutralizing layer and a timing layer. The film unit is placed in a camera, exposed through the transparent cover sheet, and then passed through a pair of pressure-applying members in the camera as it is being removed therefrom. The pressure-applying members rupture the container and spread processing composition and opacifier over the image-forming portion of the film unit. The silver halide layers are developed and dye images are formed as a function of development. The dyes diffuse to the image-receiving layer to provide an image which is viewed through the transparent support on the opaque reflecting layer background. The timing layers break down after a period of time and make available materials to neutralize the alkaline processing composition and to shut down further silver halide development.

Various other processes can also be used to produce images using the units of this invention. For instance, transparencies can be made by retaining the element containing the photosensitive layers after exposure and processing. The dyes in the non-image areas would be transferred to the mordant and the unit could be peeled apart to reveal the retained dye image in the photosensitive element. Reflective prints can also be prepared in somewhat the same manner.

The following examples further illustrate the invention.

Preparation 1

2-(4-vinylphenylamino)-4,6-dichloro-s-triazine

To a solution of 18.4 g. (0.1 mole) of cyanuric chloride in 150 ml. of acetone being stirred at 0°-5° C. was added dropwise over a ½ hr. period a solution of 11.9 g. (0.1 mole) of 4-vinylaniline and 12.9 g. (0.1 mole) of N,N-di-iso-propylethylamine. After the addition was complete, the solution was stirred at room temperature for 15 min., and then poured into 1 liter of ice water to isolate the product. The product was collected by filtration, washed with 200 ml. of water, and dried in vacuo at room temperature to give 25 g. Recrystallization from 75 ml. of benzene gave 15.0 g. (56%) (mp 152°-154°).

Anal. Found: C, 49.6; H, 3.4; Cl, 26.8; N, 19.7.

Preparation 2

Poly[vinylbenzyltrimethylammonium chloride-co-2-(4-vinylphenylamino)-4,6-dichloro-s-triazine] $(1:1)_w$ A solution of 10 g. of vinylbenzyltrimethylammonium chloride, 10 g of 2-(4-vinylphenylamino)-4,6-dichloro-s-triazine, and 100 mg. of 2,2'-azobis(2-methylpropionitrile) in 180 ml. of t-butyl alcohol was flushed with nitrogen for 15 min. and then stirred at 60° C. under nitrogen for 4 hr. At the 3 hr. point, 25 ml. of additional t-butyl alcohol was added to aid in stirring. The precipitated polymer was collected by filtration, washed with warm t-butyl alcohol and then with acetone, and dried in vacuo at room temperature to yield 19.0 g. The product was soluble in methanol.

Anal. Found: C, 56.6; H, 6.4; N, 12.9; Cl, 17.8. $[\eta]CH_3OH=2.59$.

Preparation 3

4-(4-vinylphenylamino)-2,5,6-trichloropyrimidine

To a solution of 21.8 g. (0.1 moles) of 2,4,5,6-tetrachloropyrimidine in 150 ml. of acetone being stirred at 0°-5° C. was added dropwise over a ½ hr. period a solution of 11.9 g. (0.1 mole) of 4-vinylaniline and 12.9 g. (0.1 mole) of N,N-di-iso-propylethylamine. After stirring for 2 hr. at room temperature, the product was isolated by pouring the reaction mixture into 1 l of ice water. The solid was collected by filtration and dried in vacuo at room temperature to give 28 g. Recrystallization from a solution of 120 ml. of benzene and 200 ml. of ligroin gave 17.5 g. (58%) (mp 112°-114°).

Anal. Found: C, 48.1; H, 2.7; Cl, 35.8; N, 19.2.

Preparation 4

Poly[vinylbenzyltrimethylammonium chloride-co-4-(4-vinylphenylamino)-2,5,6-trichloropyrimidine] $(1:1)_w$ A solution of 5 g. of vinylbenzyltrimethylammonium chloride, 5 g of 4-(4'-vinylphenyl)-2,5,6-trichloropyrimidine, and 100 mg. of 2,2'-azobis(2-methylpropionitrile) in 90 ml. of t-butyl alcohol was flushed with nitrogen for 15 min. and then stirred at 60° C. under nitrogen for 4 hr. Polymer began to precipitate after 15 min. The product was collected by filtration, washed with warm t-butyl alcohol and then with acetone, and dried in vacuo at R.T. to yield 10.2 g. The polymer was soluble in methanol.

Anal. Found: C, 55.5; H, 5.9; Cl, 20.5; N, 9.4.

Preparation 5

2-Methoxy-4-(4-vinylphenylamino)-6-chloro-s-triazine

To a solution of 16.4 g. (0.1 mole) 2-methoxy-4,6-dichloro-s-triazine in 150 ml. of acetone being stirred at 0°-5° C. was added dropwise over a ½ hr. period a solution of 11.9 g. (0.1 mole) of vinylaniline and 12.9 g. (0.1 mole) of N,N-di-iso-propylethylamine. After stirring at room temperature for 2 hr., the solution was poured into 1 l of ice water to isolate the product. The crude product was collected by filtration and dried in vacuo at room temperature to give 24.9 g. Recrystallization was effected by dissolution in 75 ml. of hot benzene followed by addition of ligroin to the cloud point. Yield=20.5 g. (78%) (mp 118°-122°).

Anal. Found: C, 55.2; H, 4.3; Cl, 13.2; N, 21.5.

Preparation 6

Poly[vinylbenzyltrimethylammonium chloride-co-2-methoxy-4-(4-vinylphenylamino)-6-chloro-s-triazine] $(1:1)_w$ A solution of 5 g. of vinylbenzyltrimethylammonium chloride, 5 g of 2-methoxy-4-(4-vinylphenylamino)-6-chloro-s-triazine, and 100 mg. of 2,2'-azobis(2-methylpropionitrile) in 90 ml. of t-butyl alcohol was flushed with nitrogen for 15 min. and then stirred under nitrogen at 60° C. for 6 hrs. The polymer precipitated and was collected by filtration, washed with warm t-butanol and then with acetone, and was dried in vacuo at room temperature. The yield was 9.9 g. of methanol soluble polymer.

Anal. Found: C, 58.3; H, 6.8; Cl, 11.8; N, 12.6.

Preparation 7

2-(2-Methacryloyloxyethylamino)-4,6-dichloro-s-triazine

To 194 g. of 33% 2-aminoethyl methacrylate hydrochloride solution in water being stirred at 0°-5° C. was added 1 l of additional water followed by dropwise addition of a solution of 74 g. (0.4 mole) of cyanuric chloride in 400 ml. of acetone. To this mixture was added 67.2 g. (0.8 mole) of sodium bicarbonate in portions over a 1 hr. period. The mixture was then stirred for an additional hour at room temperature. The reaction was again cooled to 0°-5° C. and the product was collected by filtration and dried in vacuo at room temperature to give 84.6 g. Recrystallization from a solution of 600 ml. of benzene and 850 ml. of ligroin with carbon decoloration yielded 56.6 g. (mp 138°-140° C.).

Anal. Found: C, 38.8; H, 3.9; Cl, 26.0; N, 19.9.

Preparation 8

Poly[2-methacryloyloxyethyltrimethylammonium methosulfate-co-2-(methacryloyloxyethylamino)-4,6-dichloro-s-triazine] $(1:1)_w$ A solution of 7 g. of 2-methacryloyloxyethyltrimethylammonium methosulfate, 7 g. of 2-(2-methacryloxyethylamino)-4,6-dichloro-s-triazine, and 70 mg. of 2,2'-azobis(2-methylpropionitrile) in 56 ml. of dimethylformamide (DMF) was flushed with nitrogen for 15 min. and was then stirred at 60° C. under nitrogen overnight. The polymer was isolated by precipitation in acetone. It was redissolved in 50 ml. of dimethylformamide, reprecipitated in acetone, collected by filtration, and dried in vacuo at room temperature. The yield was 13.0 g. of water soluble product.

Anal. Found: C, 47.0; H 6.0; Cl, 4.7; N, 13.0; S, 4.8.

Preparation 9

Poly[2-sodiosulfoethyl methacrylate-co-2-(methacryloyloxyethylamino)-4,6-dichloro-s-triazine] $(1:1)_w$ A solution of 7.5 g. of recrystallized 2-sodiosulfoethyl methacrylate, 7.5 g. of 2-(methacryloyloxyethylamino)-4,6-dichloro-triazine, and 150 mg. of 2,2'-azobis(2-methylpropionitrile) in 135 ml. of dimethylformamide was flushed with nitrogen for 15 min. and then stirred at 60° C. for 6 hrs. The polymer precipitated as a solvated gel which was collected, soaked in ligroin, and washed well with acetone. Drying in vacuo at room temperature gave 13 g. of polymer which was soluble in 50% aqueous methanol.

Anal. Found: C, 36.0; H, 4.7; Cl, 7.4; N, 8.9; S, 7.9.

Preparation 10

2-(3-Methacrylamidopropylamino)-4,6-dichloro-s-triazine

To a solution of 71.6 g. (0.4 mole) of 3-methacrylamidopropylamine hydrochloride in 400 ml. of water being stirred at 0°-5° C. was added dropwise a solution of 79 g. (0.4 mole) of cyanuric chloride in 400 ml. of acetone. To this mixture was then added in portions 67.2 g. (0.8 mole) of sodium bicarbonate over the course of 1 hr. The mixture was stirred at room temperature for an additional hour and then 2 l of water was added. The product was collected by filtration and dried in vacuo at room temperature to yield 75.8 g. The product was recrystallized from 600 ml. of ethyl acetate to give 53.2 g. (46%) (mp 138°-140° C.).

Anal. Found: C, 41.8; H, 4.7; Cl, 24.6; N, 24.6.

Preparation 11

Poly[acrylamide-co-2-(3-methacrylamido-propylamino)-4,6-dichloro-s-triazine] $(8:2)_w$ A solution of 20 g. of acrylamide, 5 g. of 2-(3-methacrylamido-propylamino)-4,6-dichloro-s-triazine, and 250 ml. of 2,2'-azobis(2-methylpropionitrile) in 225 ml. of DMF was flushed with nitrogen for 15 min. and then stirred under nitrogen at 60° C. for 4 hrs. The polymer precipitated in the form of a fine power that was difficult to collect by filtration. Water was added dropwise with stirring until the suspension agglomerated. The polymer was collected and ground in a Waring blender with acetone. Drying in vacuo gave 201 g. of water soluble product.

Anal. Found: C, 47.5; H 6.8; Cl, 4.5; N, 19.8.

Preparation 12

Poly[N,N,N-trimethyl-N-vinylbenzylammonium chloride-co-2-(3-methacrylamidopropylamino)-4,6-dichloro-s-triazine] $(1:1)_w$ A solution of 5 g. of N,N,N-trimethyl-N-vinylbenzylammonium chloride, 5 g. of 2-(3-methacrylamido-propylamino)-4,6-dichloro-s-triazine, 90 ml. of t-butyl alcohol and 100 mg. of 2,2'-azobis(2-methylpropionitrile) was flushed with nitrogen gas for about 15 minutes, then stirred under nitrogen at 60° C. for about 3 hours. The precipitated polymer was collected, washed with t-butyl alcohol and ground in a blender with acetone. The solid was collected and dried under vacuum at room temperature to produce 5 g. of water soluble product.

Anal. Found: C, 57.6; H. 7.7; Cl, 8.9; N, 10.8.

EXAMPLE 1

Evaluation of the Covalent Mordanting of Amine Dyes

The covalent mordanting of amine dyes with mordants within the scope of the present invention was evaluated according to the following procedure:

A. Receiving Elements

Dye receiving elements were prepared by coating a poly(ethylene terephthalate) film support with a layer containing gelatin at 200 mg/ft$^2$ (2.16 g/m$^2$), a bis(vinylsulfonylmethyl) ether hardener at 4.0 mg/ft$^2$ (0.04 g/m$^2$) and a mordant (see Table I) coated at 5.5 millimoles of reactive site per square meter (weight quantities in Table I).

B. Dye-Providing Elements

Two single-color photographic elements each containing a color-providing compound capable of releasing a diffusible, amine-containing dye in inverse proportion to silver halide development, were prepared according to the following:

Element A

A poly(ethylene terephthalate) film support was coated with a layer comprising a negative-working silver bromide emulsion at 100 mg. Ag/ft$^2$ (1.08 g. Ag/m$^2$), gelatin at 150 mg/ft$^2$ (1.62 g/m$^2$), a bis(vinylsulfonylmethyl) ether hardener at 3 mg/ft$^2$ (0.03 g/m$^2$) and the yellow-dye-providing compound Y-1* (below) at 49 mg/ft$^2$ (0.53 g/m$^2$) dissolved in diethyllauramide at 49 mg/ft$^2$ (0.53 g/m$^2$).

*Y-1

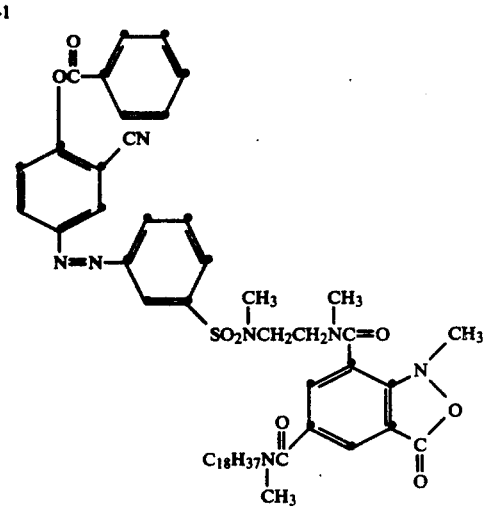

Element B

A poly(ethylene terephthalate) film support was coated with a layer comprising a negative-working silver bromide emulsion at 100 mg. Ag/ft$^2$ (1.08 g/m$^2$), gelatin at 150 mg/ft$^2$ (1.62 g/m$^2$), a bis(vinylsulfonylmethyl)ether hardener at 3 mg/ft$^2$ (0.03 g/m$^2$), the cyan-dye-providing compound C-1 (below) at 45 mg/ft$^2$ (0.49 g/m$^2$), the electron donor ED-1* (below) at 69 mg/ft$^2$ (0.75 g/m$^2$) and 2,4-di-n-amylphenol (solvent) at 57 mg/ft$^2$ (0.62 g/m$^2$).

**C-1

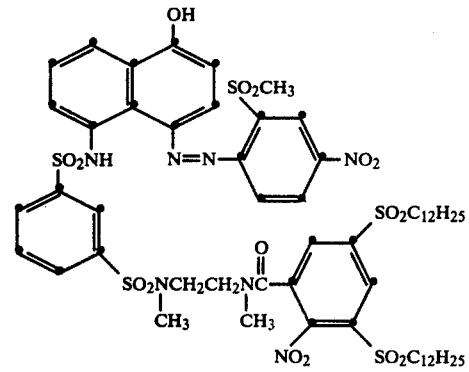

***ED-1

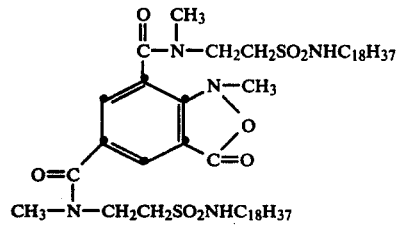

C. Mordant Testing

Separate samples of each dye receiving element were laminated to samples of the dye-providing elements A and B with a viscous alkaline activator comprising 1.2 M potassium hydroxide solution (no developer) spread therebetween at a layer thickness of 0.056 mm. After 5 minutes, the elements were separated and the receiver samples were washed in water and dried.

The dye density at maximum absorption ($\lambda_{max}$) was then measured and the percent of covalent bonding was estimated from the dye density lost after subsequent treatment of each sample for 2 minutes in an organic solvent mixture consisting of 200 ml. methanol, 200 ml. $CHCl_3$, 20 ml. $H_2O$ and 10 g $NH_2SCN$. This organic solvent mixture was specially formulated to remove substantially all dye which was not covalently bonded. After treatment with solvent the samples were washed in water for 20 minutes and air dried.

The results are tabulated in Table I.

TABLE I

| | | MORDANT | | | TRANSMISSION DENSITY AND PERCENT OF COVALENT BONDING (CB) | | | |
|---|---|---|---|---|---|---|---|---|
| | | | | | ELEMENT A | | ELEMENT B | |
| * RECEIVER | PREPARATION | g/m$^2$ | REACTIVE SITE | CHARGE | $D_{Blue}$ | % CB | $D_{Red}$ | % CB |
| X (control) | — | 1.79 | None | Cationic | 1.00 | 0 | 1.32 | 0 |
| Y (control) | — | 2.16 | None | Cationic | 1.03 | 0 | 1.30 | 0 |
| I | 2 | 2.94 | Dichloro-triazine | Cationic | 1.00 | 100 | 1.36 | 97 |
| II | 12 | 3.13 | Dichloro-triazine | Cationic | 0.98 | 63 | 1.50 | 74 |
| III | 8 | 3.06 | Dichloro-triazine | Cationic | 1.29 | 98 | 1.38 | 100 |
| IV | 11 | 8.12 | Dichloro-triazine | Nonionic | 0.38 | 100 | 0.71 | 100 |

TABLE I-continued

| * RECEIVER | PREPARATION | MORDANT g/m² | MORDANT REACTIVE SITE | CHARGE | TRANSMISSION DENSITY AND PERCENT OF COVALENT BONDING (CB) ELEMENT A $D_{Blue}$ | ELEMENT A % CB | ELEMENT B $D_{Red}$ | ELEMENT B % CB |
|---|---|---|---|---|---|---|---|---|
| V | 9 | 3.06 | Dichloro-triazine | Anionic | 0.50 | 100 | 1.19 | 88 |
| VI | 6 | 2.89 | Chloromethoxy-triazine | Cationic | 1.19 | 94 | 1.58 | 85 |
| VII | 4 | 3.32 | Trichloro-pyrimidine | Cationic | 1.02 | 61 | 1.44 | 44 |

MORDANT IDENTIFICATION

* Receiver X

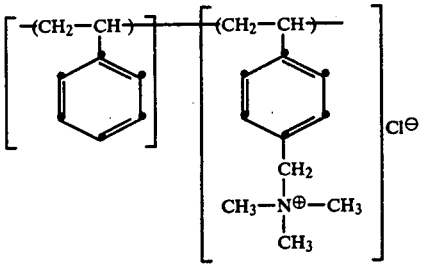

Receiver Y

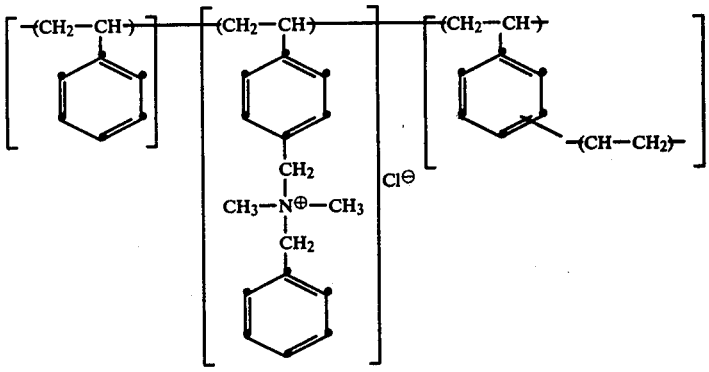

Receiver I

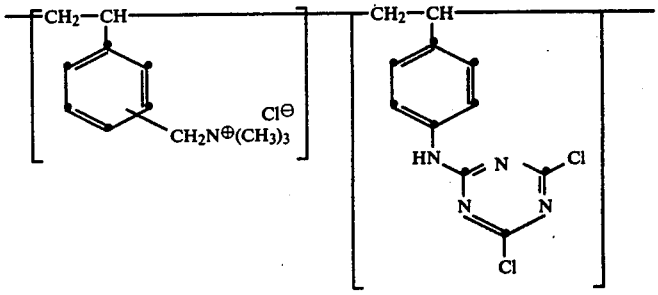

Receiver II

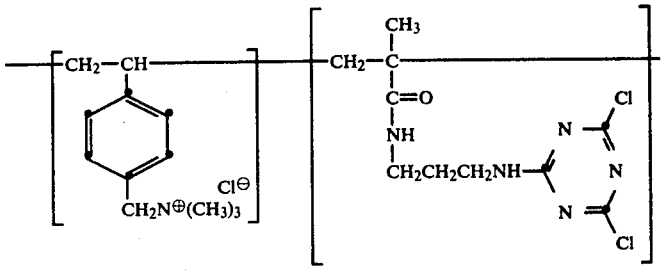

Receiver III

-continued

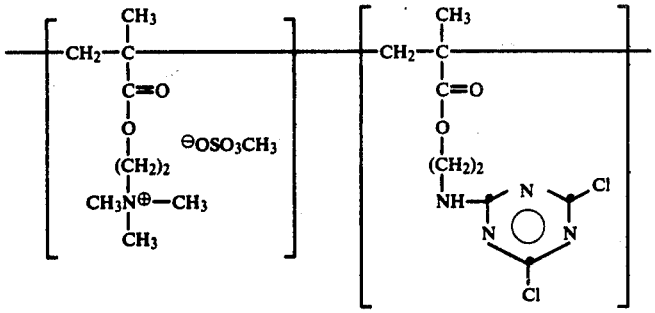

Receiver IV

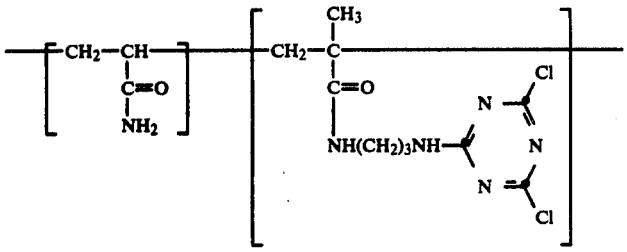

Receiver V

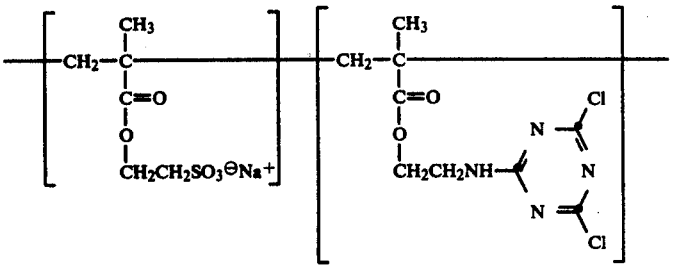

Receiver VI

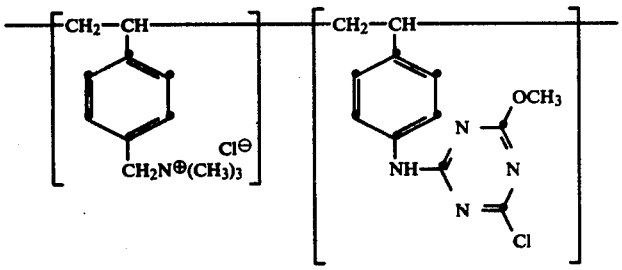

Receiver VII

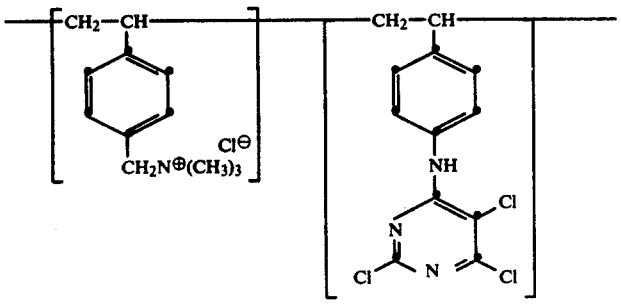

EXAMPLE 2

Evaluation of the Covalent Mordanting of Sulfonamide Dyes

Samples of the receiver elements described in Example 1 were laminated to samples of fogged (developable) photosensitive elements comprising a poly(ethylene terephthalate) support having coated thereon a layer containing a negative-working silver bromide emulsion at 0.3 g. Ag/m$^2$, gelatin at 3.3 g/m$^2$ and either the cyan-dye-releaser C-2 at 0.3 millimoles/m$^2$, magenta-dye-releaser M-1 at 0.3 millimoles/m$^2$, yellow-dye-releaser Y-2 at 0.6 millimoles/m$^2$ or yellow-dye-releaser Y-3 at 0.6 millimoles/m$^2$.

A pod containing a portion of a viscous processing composition comprising 48 g KOH, 7.2 g of 4-hydroxymethyl-4-methyl-1-phenyl-3-pyrazolidone and 40 g carboxymethyl cellulose per liter of water was spread between the laminated structure to provide a 0.056 mm thick developer layer. After 5 minutes, the elements were separated and the dyed receivers were washed in water for 20 minutes and air dried.

The percent of covalent bonding was then estimated by treatment in an organic solvent mixture as described in Example 1.

The results are recorded in Table II below.

TABLE II

| | | | TRANSMISSION DENSITY AND PERCENT OF COVALENT BONDING (CB) | | | | | | | |
|---|---|---|---|---|---|---|---|---|---|---|
| | | | YELLOW DYE (a) | | YELLOW DYE (b) | | DYE(c) | CYAN | DYE(d) | |
| *RECEIVER | MORDANT REACTIVE SITE | MORDANT CHARGE | $D_{Blue}$ | % CB | $D_{Blue}$ | % CB | $D_{Green}$ | % CB | $D_{Red}$ | % CB |
| X (control) | None | Cationic | 0.54 | 0 | 0.98 | 0 | 1.05 | 0 | 1.60 | 0 |
| Y (control) | None | Cationic | 0.49 | 0 | 0.89 | 0 | 1.16 | 0 | 1.69 | 0 |
| I | Dichloro-triazine | Cationic | 0.39 | 72 | 0.75 | 57 | 1.45 | 39 | 1.63 | 57 |
| II | Dichloro-triazine | Cationic | 0.48 | 9 | 1.03 | 11 | 1.83 | 9 | 1.69 | 12 |
| III | Dichloro-triazine | Cationic | 0.34 | 11 | 1.06 | 24 | 1.46 | 20 | 1.58 | 22 |
| IV | Dichloro-triazine | Nonionic | 0.08 | 20 | 0.10 | 50 | 0.10 | 50 | 0.18 | 30 |
| V | Dichloro-triazine | Anionic | 0.11 | 30 | 0.10 | 70 | 0.13 | 50 | 0.43 | 11 |
| VI | Chloromethoxy-triazine | Cationic | 0.46 | 6 | 1.23 | 26 | 2.09 | 15 | 1.81 | 14 |
| VII | Trichloro-pyrimidine | Cationic | 0.48 | 5 | 0.90 | 6 | 1.38 | 11 | 1.37 | 9 |

*As disclosed in Table I
(a)yellow sulfonamide dye released from Y-2
(b)yellow sulfonamide dye released from Y-3
(c)magenta sulfonamide dye released from M-1
(d)cyan sulfonamide dye released from C-2

Y-2

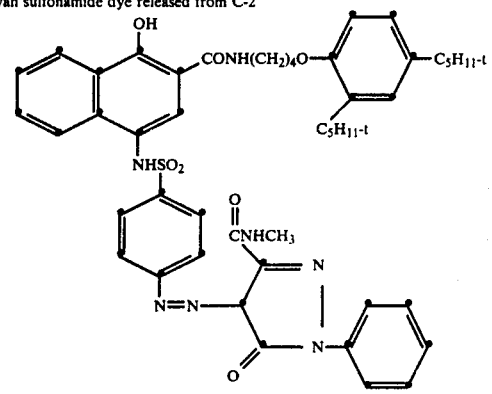

Y-3

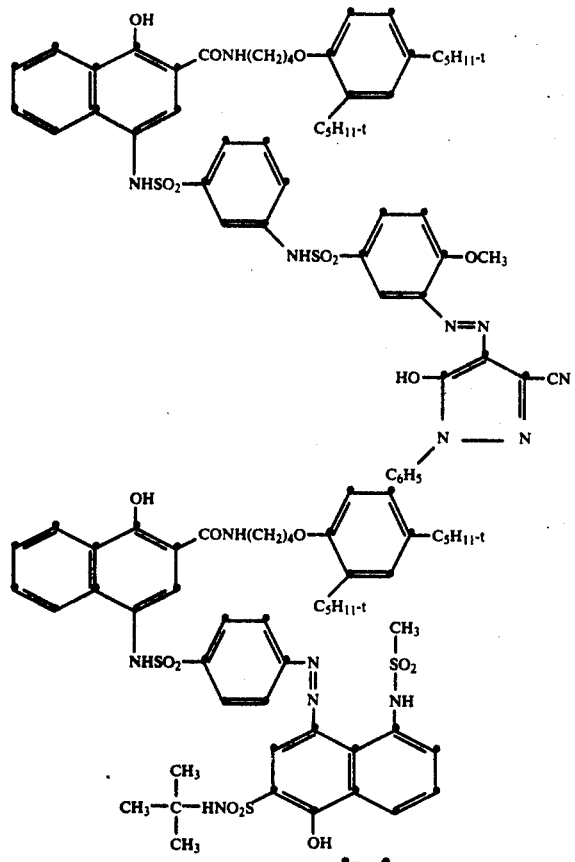

M-1

C-2

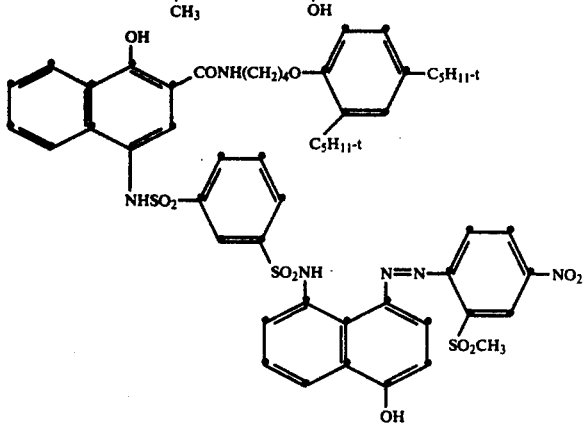

EXAMPLE 3

Evaluation of Covalent Mordanting of Phenol Dyes

Samples of the receiver elements described in Example 1 were laminated to samples of single layer, photosensitive image transfer elements containing quinone dye-releasers. Each element consisted of a poly(ethylene terephthalate) film support having coated thereon a layer containing a negative-working silver halide emulsion at 100 mg. Ag/ft$^2$ (1.08 g/m$^2$), gelatin at 200 mg/ft$^2$ (2.16 g/m$^2$), a ballasted electron-accepting nucleophilic displacement (BEND) compound as the dye-providing substance, and an electron donor. The BEND compound and electron donor were dissolved in an equal weight of diethyllauramide and dispersed in gelatin prior to coating.

| Dye-Providing Elements | | | |
|---|---|---|---|
| BEND Compound* | | Electron Donor* | |
| Code No. | moles/ft$^2$ | Code No. | moles/ft$^2$ |
| Y-4 | $5 \times 10^{-5}$ | ED-2 | $1.0 \times 10^{-4}$ |
*Compounds identified below.
Y-4
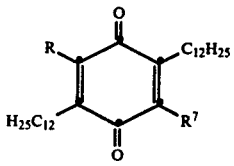
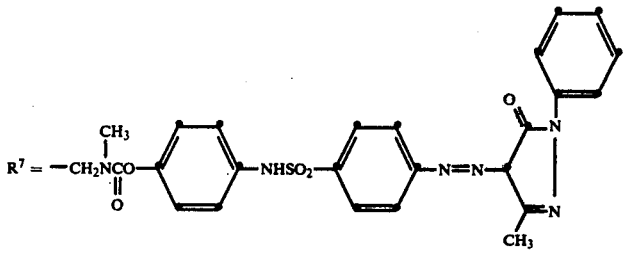
C-3
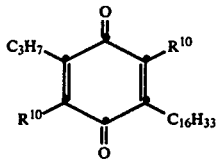
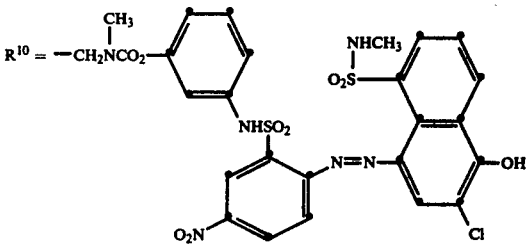
ED-2
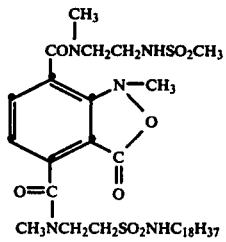
ED-3
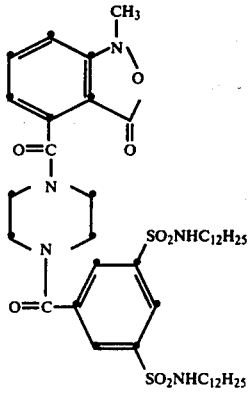

The phenol dyes released from the quinone BEND compounds were transferred to the receiver elements by employing the procedure described in Example 1.

The percent of covalent bonding was then estimated by treatment in an organic mixture as described in Example 1.

The results are recorded in Table III.

TABLE III

| *RECEIVER | MORDANT REACTIVE SITE | MORDANT CHARGE | TRANSMISSION DENSITY AND PERCENT OF COVALENT BONDING (CB) YELLOW DYE 1[a] $D_{Blue}$ | % CB | CYAN DYE [b] $D_{Blue}$ | % CB |
|---|---|---|---|---|---|---|
| X (control) | None | Cationic | 0.70 | 0 | 1.10 | 0 |
| Y (control) | None | Cationic | 0.61 | 0 | 1.08 | 0 |
| I | Dichloro-triazine | Cationic | 0.72 | 100 | 1.15 | 100 |
| II | Dichloro-triazine | Cationic | 0.51 | 37 | 1.12 | 14 |
| III | Dichloro-triazine | Cationic | 0.51 | 67 | 1.20 | 53 |
| IV | Dichloro-triazine | Nonionic | 0.34 | 85 | 0.21 | 95 |
| V | Dichloro-triazine | Anionic | 0.39 | 97 | 0.43 | 83 |
| VI | Chloromethoxy-triazine | Cationic | 0.56 | 82 | 1.26 | 47 |
| VII | Trichloro-pyrimidine | Cationic | 0.55 | 51 | 1.07 | 19 |

*As described in Table I.
[a]Phenol dye released from Y-4
[b]Phenol dye released from C-3

The invention has been described in detail with particular reference to certain preferred embodiments thereof, but it will be understood that variations and modifications can be effected within the spirit and scope of the invention.

We claim:

1. A photographic element comprising a support and a silver halide emulsion layer, having associated therewith a layer or layers comprising a photographically useful fragment having appended thereto a nucleophilic moiety selected from the group consisting of $ZNHR^2$, $SO_2NHR^2$ and

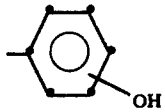

wherein $R^2$ is H or alkyl and Z is selected from the group consisting of alkylene, arylenealkylene, cycloalkylene, or the atoms which, taken together with $NHR^2$, complete an N-containing heterocyclic group; and a polymeric mordant comprising recurring units having the formula:

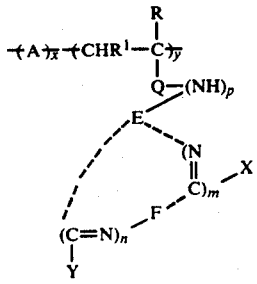

wherein A is one or more polymerized units of $\alpha,\beta$-ethylenically unsaturated monomers, R is H or alkyl containing from 1 to 6 carbon atoms, Q is a linking group selected from the group consisting of alkylene, arylene, arylenealkylene, $COOR^3$, and $CONHR^3$ wherein $R^3$ is selected from the group consisting of alkylene, arylene and arylenealkylene, $R^1$ is H, alkyl, an aromatic group or the atoms which, taken together with Q, form a

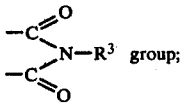

each Y is selected from the group consisting of H or an inert group, X is a leaving group which can be displaced by nucleophiles, E and F represent the atoms necessary to complete a 5- to 7-membered heterocyclic ring, n is from 0 to 2, m is from 1 to 3, p is 0 or 1, x is 0 to 90 percent by weight and y is from 10 to 100 percent by weight of the polymer.

2. The photographic element of claim 1 wherein the photographically useful fragment is selected from the group consisting of dyes, dye precursors, development inhibitors, development accelerators, bleach inhibitors, bleach accelerators, couplers, developing agents, silver halide solvents, silver complexing agents, toners, hardeners, fogging agents, antifoggents, chemical spectral sensitizers and desensitizers.

3. The photographic element of claim 1 wherein the polymer is a cationic polymer.

4. The photographic element of claim 1 wherein the polymer is an anionic polymer.

5. The photographic element of claim 1 wherein the polymer is a nonionic polymer.

6. The photographic element of claim 1 wherein X is selected from the group consisting of an onium group, halogen, alkyl sulfonyl, aryl sulfonyl, alkyl sulfonyloxy, aryl sulfonyloxy and sulfato.

7. The photographic element of claim 1 wherein x is from 30 to 70 weight percent and y is from 70 to 30 weight percent.

8. The photographic element of claim 1 wherein the polymer is a copolymer containing units of vinylbenzyltrimethylammonium chloride.

9. A photographic element comprising a support and a silver halide emulsion layer, having associated therewith a layer or layers comprising a dye or dye precursor having appended thereto a moiety selected from the group consisting of $ZNHR^2$, $SO_2NHR^2$ and

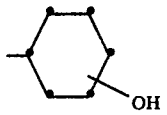

wherein $R^2$ is H or alkyl and Z is selected from the group consisting of alkylene, arylenealkylene, cycloalkylene, or the atoms which, taken together with $NHR^2$, complete an N-containing heterocyclic group; and a polymeric mordant comprising recurring units having the formula:

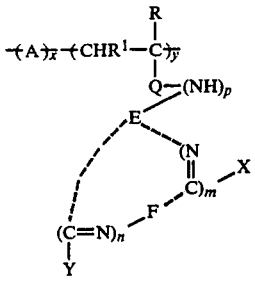

wherein A is one or more polymerized units of α,β-ethylenically unsaturated monomers, R is H or alkyl containing from 1 to 6 carbon atoms, Q is a linking group selected from the group consisting of alkylene, arylene, arylenealkylene, $COOR^3$, and $CONHR^3$ wherein $R^3$ is selected from the group consisting of alkylene, arylene and arylenealkylene, $R^1$ is H, alkyl or an aromatic group, or the atoms which, taken together with Q, form a

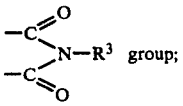

each Y is selected from the group consisting of H or an inert group, X is a leaving group which can be displaced by nucleophiles, E and F represent the atoms necessary to complete a 5- to 7-membered heterocyclic ring, n is from 0 to 2, m is from 1 to 3, p is 0 or 1, x is 0 to 90 percent by weight and y is from 10 to 100 percent by weight of the polymer.

10. The photographic element of claim 9 wherein the polymer is a cationic polymer.

11. The photographic element of claim 9 wherein the polymer is an anionic polymer.

12. The photographic element of claim 9 wherein the polymer is a nonionic polymer.

13. The photographic element of claim 9 wherein the polymer is a copolymer containing units of vinylbenzyltrimethylammonium chloride.

14. The photographic element of claim 9 wherein the polymeric mordant comprises a copolymer comprising from 30 to 70 weight percent of ethylenically unsaturated monomers and from about 70 to 30 weight percent of the units of claim 10.

15. A photographic film unit comprising:

(a) a support having thereon at least one photosensitive silver halide emulsion layer having associated therewith a dye or dye precursor having appended thereto a moiety selected from the group consisting of $ZNHR^2$, $SO_2NHR^2$ and

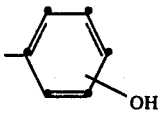

wherein $R^2$ is H or alkyl and Z is selected from the group consisting of alkylene, arylenealkylene, cycloalkylene or the atoms which, taken together with $NHR^2$, complete an N containing heterocyclic group;

(b) a dye-image receiving layer comprising a polymeric mordant, said polymer containing recurring units having the formula:

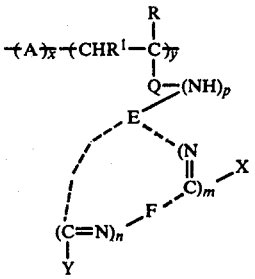

wherein A is one or more polymerized units of α,β-ethylenically unsaturated monomers, R is H or alkyl containing from 1 to 6 carbon atoms, Q is a linking group selected from the group consisting of alkylene, arylene, arylenealkylene, $COOR^3$, and $CONHR^3$ wherein $R^3$ is selected from the group consisting of alkylene, arylene and arylenealkylene, $R^1$ is H, alkyl or an aromatic group, or the atoms which, taken together with Q, form a

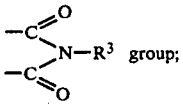

each Y is selected from the group consisting of H or an inert group, X is a leaving group which can be displaced by nucleophiles, E and F represent the atoms necessary to complete a 5- to 7-membered heterocyclic ring, n is from 0 to 2, m is from 1 to 3, p is 0 or 1, x is 0 to 90 percent by weight and y is from 10 to 100 percent by weight of the polymer; and (c) alkaline processing composition and means for discharging same within said film unit in contact with said photosensitive layer;

said film unit containing a silver halide developing agent.

16. The photographic film unit of claim 15 additionally comprising:

(d) a neutralizing layer for neutralizing said alkaline processing composition; and (e) a timing layer which is permeable by said alkaline processing composition after a predetermined time and is located between said neutralizing layer and said photosensitive silver halide emulsion.

17. The photographic film unit of claim 16 wherein:

(a) said dye image-receiving layer is located between said support and said silver halide emulsion layer; and (b) said film unit also includes a transparent cover sheet over the layer outermost from said support.

18. The photographic film unit of claim 16 wherein:

(a) said dye image-receiving layer is located between said support and said silver halide emulsion layer; and (b) said film unit also includes a transparent cover sheet located between said support and said dye image-receiving layer.

19. The photographic film unit of claim 16 wherein said discharging means is a rupturable container containing said alkaline processing composition and an opacifying agent, said container being so positioned during processing of said film unit that a compressive force applied to said container will effect a discharge of the container's contents between said cover sheet and the outermost layer of said photosensitive element.

20. The photographic film unit of claim 15 comprising:

(a) a photosensitive element comprising a transparent support having thereon the following layers in sequence: an image-receiving layer of claim 19; an alkaline solution-permeable, light-reflective layer; an alkaline solution-permeable opaque layer; a red-sensitive silver halide emulsion layer having a ballasted redox cyan dye releaser associated therewith; a green-sensitive silver halide emulsion layer having a ballasted redox magenta dye releaser associated therewith; and a blue-sensitive silver halide emulsion layer having a ballasted redox yellow dye releaser associated therewith;

(b) a cover sheet superposed over said blue-sensitive silver halide emulsion layer and comprising a transparent support coated with a neutralizing layer and a timing layer; and (c) a rupturable container containing said alkaline processing composition of claim 19 and an opacifying agent, said container being so positioned during processing of said film unit that a compressive force applied to said container will effect a discharge of the container's contents between said cover sheet and said blue-sensitive silver halide emulsion layer.

21. The photographic film unit of claim 15 wherein the polymeric mordant is a cationic polymer.

22. The photographic film unit of claim 15 wherein the polymeric mordant is an anionic polymer.

23. The photographic film unit of claim 15 wherein the polymeric mordant is a nonionic polymer.

24. The photographic film unit of claim 15 wherein the image-receiving layer comprises a copolymer comprising from 30 to 70 weight percent of ethylenically unsaturated monomers and from about 70 to 30 weight percent of said recurring units.

25. The photographic film unit of claim 15 wherein the polymer contains units of vinylbenzyltrimethylammonium chloride.

26. In a process of producing a photographic transfer image in a photographic element comprising a support having thereon at least one photosensitive silver halide emulsion layer having associated therewith a dye image-providing material, a receiving layer, a barrier associated with a neutralizing layer being permeable by said alkaline processing composition after a predetermined time and which is located between said photosensitive silver halide emulsion layer and said neutralizing layer, comprising:

(a) exposing said photographic element;

(b) treating said element with an alkaline processing composition in the presence of a silver halide developing agent to effect development of each of said exposed silver halide emulsion layers, (i) an imagewise distribution of dye image-providing material being formed as a function of development and (ii) at least a portion of said imagewise distribution of dye image-providing material diffusing to said dye image-receiving layer; and (c) neutralizing said alkaline processing composition by means of said neutralizing layer associated with said photographic element after said predetermined time;

the improvement wherein said dye image-providing material has appended thereto a moiety selected from the group consisting of $ZNHR^2$, $SO_2NHR^2$ and

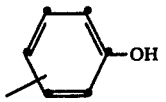

wherein $R^2$ is H or alkyl and Z is selected from the group consisting of alkylene, arylenealkylene, cycloalkylene or the atoms which, taken together with $NHR^2$, complete an N containing hererocyclic group; and the receiving layer contains a polymer containing recurring units having the formula:

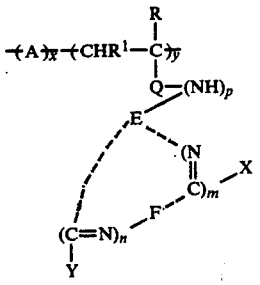

wherein A is one or more polymerized units of $\alpha,\beta$-ethylenically unsaturated monomers, R is H or alkyl containing from 1 to 6 carbon atoms, Q is a linking group selected from the group consisting of alkylene, arylene, arylenealkylene, $COOR^3$, and $CONHR^3$ wherein $R^3$ is selected from the group consisting of alkylene, arylene and arylenealkylene, $R^1$ is H, alkyl or an aromatic group, or the atoms which, taken together with Q, form a

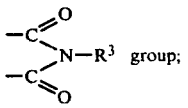
group;

each Y is selected from the group consisting of H or an inert group, X is a leaving group which can be displaced by nucleophiles, E and F represent the atoms necessary to complete a 5- to 7-membered heterocyclic ring, n is from 0 to 2, m is from 1 to 3, p is 0 or 1, x is 0 to 90 percent by weight and y is from 10 to 100 percent by weight of the polymer, said photographically useful and/or active fragment and said recurring units forming a covalent bond on contact.

* * * * *